United States Patent [19]

Papajewski et al.

[11] 3,991,692

[45] Nov. 16, 1976

[54] BOBBIN THREAD DEPLETION DETECTOR FOR SEWING MACHINE

[75] Inventors: Reinhold Papajewski, Buchig; Heinz Emil Walter, Blankeloch, both of Germany

[73] Assignee: The Singer Company, New York, N.Y.

[22] Filed: Sept. 18, 1975

[21] Appl. No.: 614,443

[52] U.S. Cl. ..... 112/218 R

[51] Int. Cl.[2] ..... B65H 63/02

[58] Field of Search ..... 112/219 R, 218 R; 200/61.18, 61.16, 61.13

[56] References Cited

UNITED STATES PATENTS

| | | | |
|---|---|---|---|
| 2,420,275 | 5/1947 | Winberg | 112/218 R |
| 2,647,482 | 8/1953 | Campbell | 112/218 R |
| 3,129,680 | 4/1964 | Doerner | 112/218 R |
| 3,601,073 | 8/1971 | Simpson | 112/218 R |

*Primary Examiner*—H. Hampton Hunter
*Attorney, Agent, or Firm*—Edward L. Bell; Robert E. Smith; Julian Falk

[57] ABSTRACT

A bobbin thread depletion signal for lock stitch sewing machines or the like. The bobbin, which is constructed so that one of the end flanges is free to slide axially along the hub, is horizontally mounted in the machine bobbin carrier. When thread is wound on the bobbin, the slideable flange is forced outward against a stop and is positioned in the field of an electronic sensor, such as an oscillator coil, the inductance of which is altered by a proximity of the slideable flange. When the thread is removed from the hub, the slideable end flange will drop from the environment of the sensor toward the stationary flange thereby producing an inductance change that is detected by electronic sensor circuitry that signals the sewing machine operator.

2 Claims, 3 Drawing Figures

Fig. 1
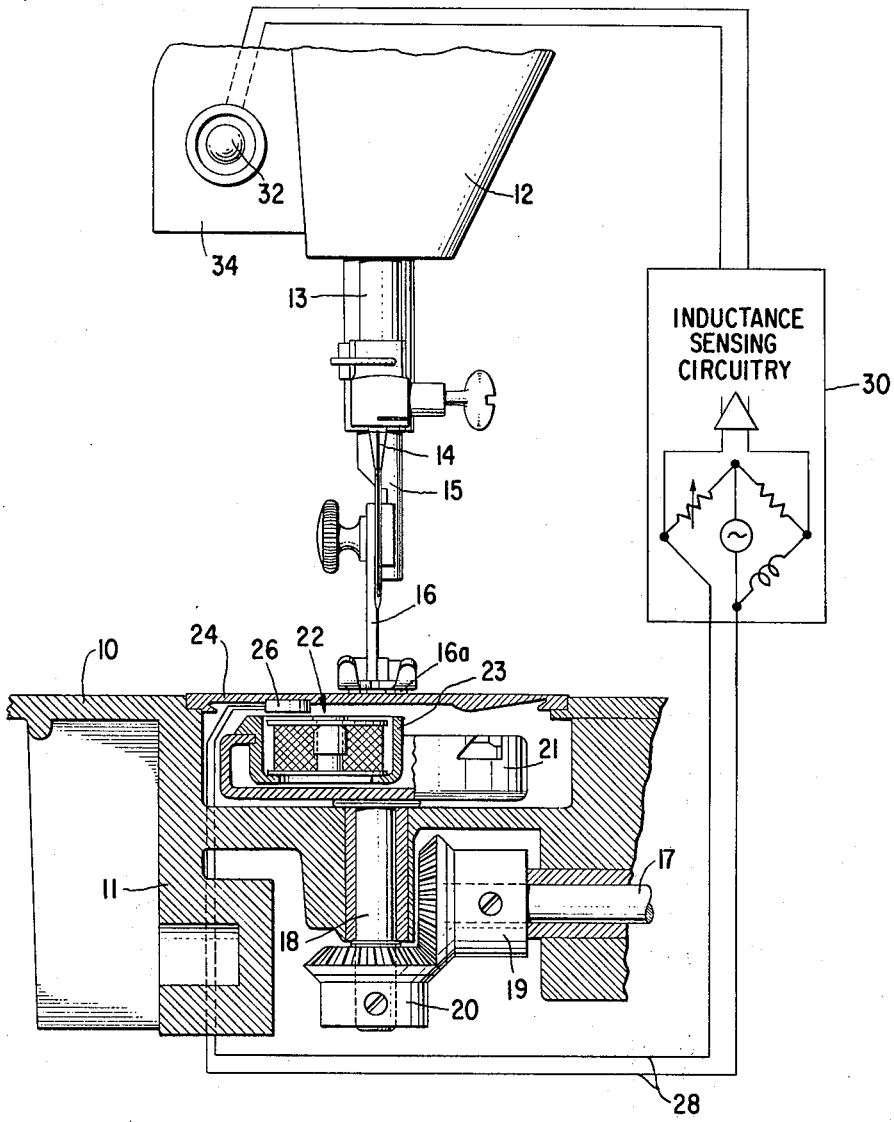
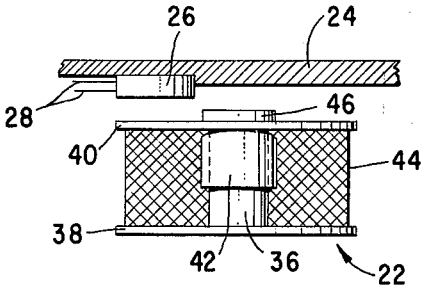
Fig. 2
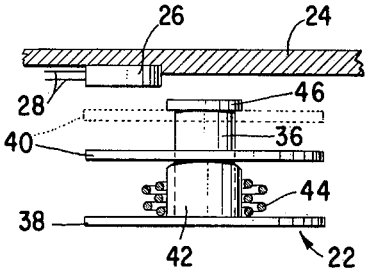
Fig. 3

BOBBIN THREAD DEPLETION DETECTOR FOR SEWING MACHINE

BACKGROUND OF THE INVENTION

This invention relates generally to sewing machines and particularly to a novel warning device that produces a signal to the operator when the supply of the bobbin thread is approaching depletion.

Numerous attempts have been made to develop bobbin thread depletion sensors that are safe, reliable, and can be easily used by both the skilled and the untrained sewing machine operator. Some of the prior devices make use of complex bobbins that are difficult to load such as those containing mechanical linkages in the bobbin that sense the depletion of the bobbin thread supply and then, for example, trigger electrical signalling circuits. For example, in the U.S. Pat. No. 3,129,680, the depletion of the bobbin thread supply releases a spring loaded magnet from a position adjacent the hub of the bobbin and permits the magnet to reposition itself along the periphery of the bobbin where it can actuate a magnetic reed switch that signals the operator of the bobbin thread supply deletion.

In another system, the depletion of the thread releases a spring loaded conductive member which bridges a pair of electrical contacts to complete the electrical signalling circuit. While such systems may prove to be reliable, the complexity of the bobbin structure is both costly and confusing to the operator. Furthermore, signalling systems employing electrical signal contacts may prove hazardous to even the highly skilled operator.

SUMMARY OF THE INVENTION

Briefly described, the present invention is for a bobbin thread depletion signalling device that includes a relatively simple and reliable bobbin having a fixed or stationary flange attached to the bobbin hub and a movable flange which is free to slide axially along the hub toward the fixed flange when the bobbin thread supply is nearly depleted. The movable flange, when forced away from the fixed flange by a thread wound on the bobbin hub, is in the electric field of a sensing coil coupled to an inductance sensing circuit. When the bobbin thread supply is depleted, the movable flange is free to drop thereby altering the inductance of the sensing coil and causing the associated sensing circuit to light a warning lamp visible to the machine operator.

DRAWINGS

In the drawings which illustrate a preferred embodiment of the invention:

FIG. 1 is an elevational view, partly in section, of a sewing machine and illustrates the general positioning of the bobbin and sensing coil of the invention;

FIG. 2 is an enlarged vertical sectional view illustrating a full bobbin and a typical relationship between the sensing coil and the movable flange; and FIG. 3 is an enlarged elevational view illustrating a nearly-depleted bobbin and the relative position of the movable flange with respect to the sensing coil.

DETAILS OF THE DESCRIPTION

Illustrated in FIG. 1 is a sectional view of a portion of a lock stitch sewing machine having a base 10 with a vertical end wall 11 and a head 12 carrying a needle bar 13, needle 14, presser bar 15, presser foot 16 and feed dog **16*a***.

A bed shaft 17 drives a hook shaft 18 through bevel gears 19 and 20 to impart rotary movement to a hook 21. A bobbin 22 is shown seated within the bobbin case 23 in its relation to the rotary hook 21. A removable slide plate 24 covers the rotary hook mechamism and may be readily pulled back to gain access for bobbin removal and replacement as is well-known.

Secured to the bottom surface of the slide plate 24 by any suitable means, is a sensor coil 26 which may be coupled through conductors 28 to an inductance sensing circuit 30. The circuit 30 may be any suitable inductance sensor such as an inductance bridge circuit or an oscillator having a tuned tank circuit that is detuned by an inductance change in the coil 26 to generate a signal that will provide electrical excitation to a lamp 32 connected to the sewing machine head 12 by a suitable bracket 34 so that lamp 32 is readily visible to the sewing machine operator.

FIG. 2 illustrates the details of bobbin 22 and its relationship with the sensor coil 26. Bobbin 22 is comprised of a tubular hub 36 having a circular flange 38 rigidly attached to its lower end. A movable flange 40 is mounted to a tubular collar 42 which loosely telescopes over the hub 36. As more clearly illustrated in FIG. 3, the collar 42 has a length substantially less than the length of hub 36 so that the collar 42 with the attached movable flange 40 is free to move axially along the hub 36 and is prevented from removal by a ring stop 46 which is attached to the hub 36 at the end opposite the flange 38.

All the components comprising the bobbin may be metallic or may be plastic except that the movable flange 40 is made of a ferro-magnetic material so that, when adjacent the sensor coil 26, it will affect the inductance of that coil. When the bobbin thread 44 has been depleted or is nearly exhausted, as illustrated in FIG. 3, the movable flange 40 is no longer held in its upper position by the thread 44 and is permitted to drop. Therefore, the inductance of the coil 26 is changed and the change is sensed by the sensing circuit 30 which activates the lamp 32 to indicate to the operator that the bobbin thread has been depleted.

Having thus set forth the nature of the invention, what is claimed herein is:

1. A bobbin thread depletion detector for sewing machines comprising:

a horizontally mounted bobbin having an upper ferro-magnetic flange movably axially along the hub of said bobbin, said movable flange being held in a raised position by thread wound on said bobbin;

an electromechanical sensing coil positioned adjacent the movable flange of said bobbin whereby said movable flange acts as a shunt to said sensing coil;

inductance sensing circuitry coupled to detect changes in the inductance of said sensing coil, due to the movement of said movable flange having been released by the depletion of said bobbin thread; and alarm means coupled to said circuitry for signalling the sewing machine operator of inductance changes in said sensing coil.

2. The bobbin thread depletion detector claimed in claim 1 wherein said movable flange is connected to a tubular collar slidably mounted over said hub.

* * * * *